US007137618B2

(12) United States Patent
Koenecke

(10) Patent No.: US 7,137,618 B2
(45) Date of Patent: Nov. 21, 2006

(54) POWER-ASSISTED CABLE-PULLING DEVICE

(76) Inventor: Robert F. Koenecke, 3312 - 368th Ave., Burlington, WI (US) 53105

( * ) Notice: Subject to any disclaimer, the term of this patent is extended or adjusted under 35 U.S.C. 154(b) by 81 days.

(21) Appl. No.: 11/089,913

(22) Filed: Mar. 25, 2005

(65) Prior Publication Data

US 2006/0231811 A1 Oct. 19, 2006

(51) Int. Cl.
*B66D 1/30* (2006.01)

(52) U.S. Cl. ..... 254/372; 254/360; 254/361

(58) Field of Classification Search ..... 254/217, 254/221, 222, 223, 228, 276, 360, 361, 369, 254/372, 376, 380
See application file for complete search history.

(56) References Cited

U.S. PATENT DOCUMENTS

| | | | | |
|---|---|---|---|---|
| 2,269,438 | A | 1/1942 | Coffing | |
| 3,758,079 | A * | 9/1973 | Workman et al. | 254/360 |
| 4,369,576 | A | 1/1983 | Mc Vaugh | |
| 4,478,390 | A * | 10/1984 | Knight et al. | 254/270 |
| 4,500,074 | A * | 2/1985 | Fox et al. | 254/270 |
| 4,995,776 | A | 2/1991 | Kato | |
| 5,113,679 | A | 5/1992 | Ferraro et al. | |
| 5,152,162 | A | 10/1992 | Ferraro et al. | |
| 5,388,781 | A | 2/1995 | Sauber | |
| 5,477,680 | A | 12/1995 | Heskey et al. | |
| 5,553,478 | A | 9/1996 | Di Trola | |
| 5,657,417 | A | 8/1997 | Di Trola | |
| 5,727,417 | A | 3/1998 | Moffatt et al. | |
| 5,772,184 | A * | 6/1998 | Zaguroli, Jr. | 254/361 |
| 6,076,805 | A | 6/2000 | Messersmith | |
| 6,095,500 | A | 8/2000 | McVaugh | |
| 6,102,371 | A | 8/2000 | Wyers | |
| 6,196,045 | B1 | 3/2001 | Thomas et al. | |
| 6,508,456 | B1 | 1/2003 | Hulburd et al. | |
| 6,729,104 | B1 * | 5/2004 | Marshall | 53/331 |
| 6,805,028 | B1 | 10/2004 | Chang | |
| 2004/0177495 | A1 | 9/2004 | Itrich | |

OTHER PUBLICATIONS

Coffing Hoists and Little Mule Products, Country Club Road, P.O. Box 779, Wadesboro, NC 28170 at http://www.coffinghoists.com/lever.html.

Cole-Parmer Technical Library, *Positive Displacement Pump Types*, a guide for product comparisons at http://www.coleparmer.com/techinfo/print.asp?htmfile=PosDisPumpsTerms.htm.

(Continued)

*Primary Examiner*—Emmanuel M Marcelo
(74) *Attorney, Agent, or Firm*—Jansson, Shupe, Munger & Antaramian, Ltd.

(57) ABSTRACT

The invention involves a hand held, power-assisted cable-pulling apparatus. The hand held, power-assisted cable-pulling apparatus has a housing, a take-up wheel, a drive transfer coupling, at least one dog pawl, a line, and a ground fixation mechanism. The housing has a hollow handle body within which is a fluid-powered actuator, a fluid control valve, for controlling fluid pressure supply to the actuator, and an operating trigger for the control valve. The wheel has a circumferential line-engaging portion and a concentric ratchet portion. The take-up wheel rotates about a take-up wheel shaft, which extends through the center of the take-up wheel. The take-up wheel shaft is attached with respect to the housing. Further, there is at least one dog pawl pivotally attached with respect to the housing. There is also a line having a cable attachment mechanism. The take-up wheel may be selectively rotated in a clockwise take-up direction.

18 Claims, 7 Drawing Sheets

OTHER PUBLICATIONS

Labcor Gear Pumps, Introduction/Compact, catalog p. 1497; full catalog listed on www.labcor.com.

Cole-Parmer Pumps, Positive Displacement, Introduction/Air Powered, catalog p. 1558; full catalog listed on www.coleparmer.com.

The ROBO Family of Tools for Huskie Tools dated Feb. 16, 2005 at http://www.huskietools.com/details.cfm?ID=607.

Airline Hydraulic's Main Page, Basic Symbols, p. 1-10 at http://www.airline hyd.com/KnowledgeCenter/Symbols.asp.

Aluminum Contruction—Low Handle Effort, PA Model Ratchet Lever Hoist as seen at http://www.coffinghoists.com/assets/PA.pdf for the PA version, pp. 39 and 88.

* cited by examiner

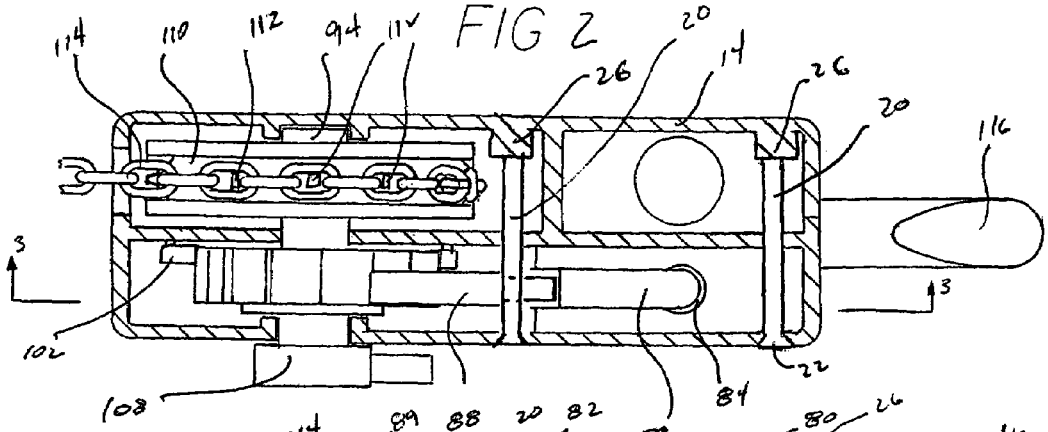
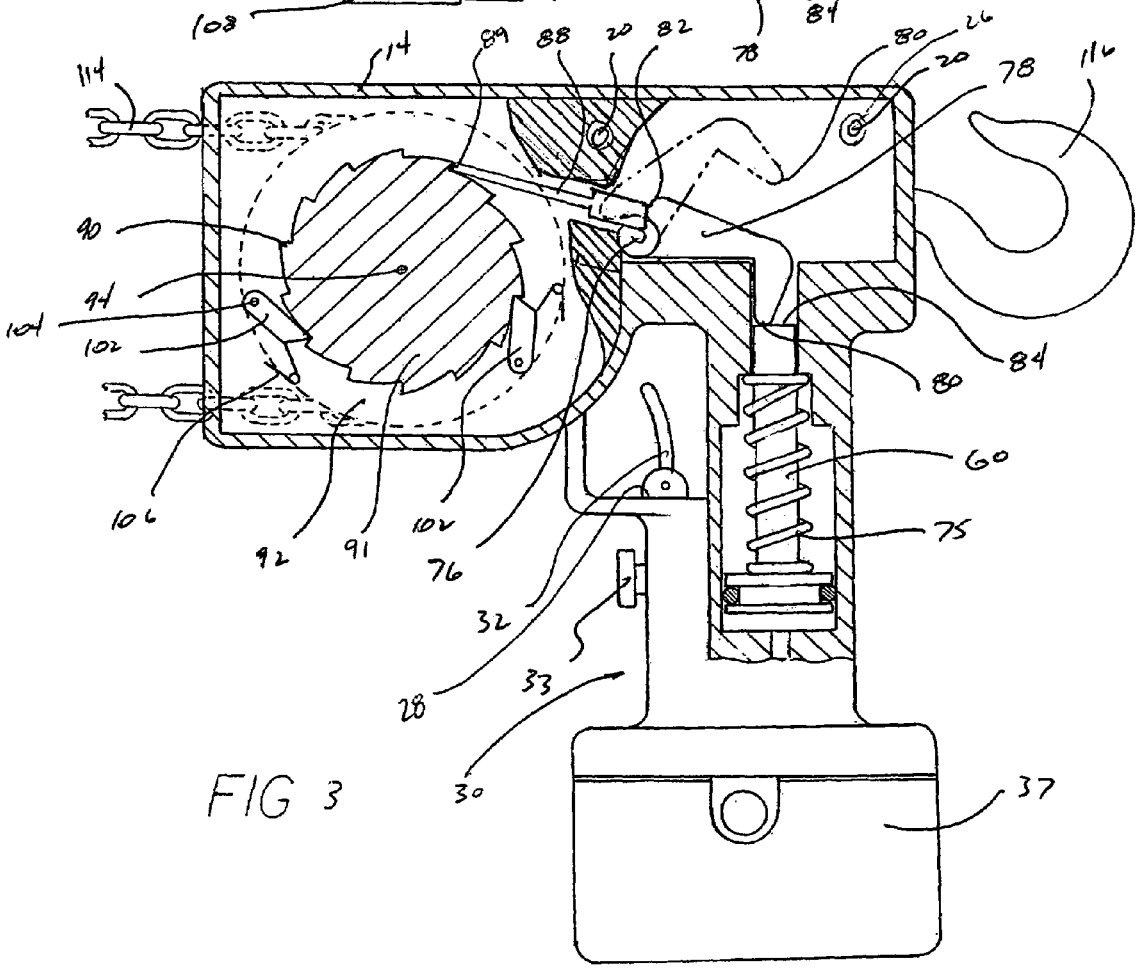
FIG 3

POWER-ASSISTED CABLE-PULLING DEVICE

FIELD OF THE INVENTION

This invention is related generally to cable-pulling devices and, more particularly, to power-assisted cable-pulling devices.

BACKGROUND OF THE INVENTION

One of the duties of a lineman is pulling large wire cables. Currently, a lineman attaches a press device to the cable to be pulled. The press device is in turn attached to a line hook. The line hook is then attached to the hoist hook of a hoist.

In some instances, truck-mounted or truck-pulled, trailer-mounted winches are appropriate for pulling the cable. In such instances, trucks have to have accessibility to the area where the pulling is to occur. Thus, in the first instance, such truck-mounted winches are unavailable for off-road or aerial use. Moreover, it is costly to outfit a truck with such a winch for general maintenance use. Further, such truck-mounted winches occupy much-needed storage space for other maintenance equipment. An example of such a trailer-mounted winch is illustrated in U.S. Pat. No. 5,388,781 (issued to Sauber).

More frequently than truck-mounted winches, portable ratchet hoists are used by linemen. Examples of portable, manual, ratchet-type hoists are made by Coffing® (a division of Yale Industrial Products, Inc.), AB Chance (a division of Hubbell® Power Systems), or Maasdam Pow'R-Pull, Inc. Such manual hoists have a hoist hook and a fixing hook. The fixing hook is attached to a fixture, such as a pole or tree. The hoist hook is attached to the hoist by a chain. Once the hoist hook and fixing hook are attached to the line hook and fixture, respectively, slack is taken out of the line through a lever action applied to a ratchet rotating the chain take-up wheel.

In order to drive the ratchet, a lineman uses his or her arm, preferably driving the lever with proper body mechanics on each stroke. Use of the ratchet has resulted in chronic motion injury such as "tennis elbow" (also known as lateral epicondylitis), rotator cuff tears, shoulder strains, and tendinitis. These injuries are well known in the industry.

A portable, powered line-pulling apparatus facilitating easy and safe cable pulling would be an important improvement in the art.

OBJECTS OF THE INVENTION

It is an object of the invention to provide an improved cable-pulling device overcoming some of the problems and shortcomings of the prior art, including those referred to above.

Another object of the invention is to provide a cable-pulling device that provides ease of operation.

Another object of the invention is to provide a cable-pulling device that is portable by a person into areas that are inaccessible to trucks.

Still another object of the invention is to provide a cable-pulling device that diminishes the possibility of repetitive stress injuries for linemen.

Yet another object of the invention is to provide a powered cable-pulling device that is inexpensive.

Another object of the invention is to provide a cable-pulling device that can be operated with minimal addition training over that provided to linemen using manual hoists to pull cable.

How these and other objects are accomplished will become apparent from the following descriptions and the drawings.

SUMMARY OF THE INVENTION

The invention involves a hand held, power-assisted cable-pulling apparatus. The hand held, power-assisted cable-pulling apparatus has a housing, a disc-like take-up wheel, a drive transfer coupling, at least one ratchet-portion-engageable dog pawl, a line, and a ground fixation mechanism. The housing has a hollow handle body within which is a fluid-powered actuator, a fluid control valve, for controlling fluid pressure supply to the actuator, and an operating trigger for the control valve. When used herein, the term "fluid" includes all non-solid substances, including liquids and gasses. The disc-like take-up wheel has a circumferential line-engaging portion and a concentric ratchet portion. The take-up wheel rotates about a take-up wheel shaft, which extends through the center of the take-up wheel. The shaft has a longitudinal axis about which the take-up wheel rotates. The take-up wheel shaft is attached with respect to the housing. The drive transfer coupling maintains an operative driving connection between the actuator and the ratchet portion. Further, there is at least one ratchet-portion-engageable dog pawl pivotally attached with respect to the housing. There is also a line having a cable attachment mechanism and non-slippingly engaged with the take-up-wheel line-engaging portion. The ground fixation mechanism is attached with respect to the housing for maintaining the housing fixed in space while power-assisted cable-pulling apparatus is in operation. The take-up wheel may be selectively rotated in a clockwise take-up direction.

In certain embodiments, it is advantageous for the ground fixation mechanism to include a fixation-mechanism hook. In certain of these embodiments, it is even more advantageous for the fixation-mechanism hook to be configured to be able to rotate about the fixation-mechanism-hook axis. In this way, the fixation-mechanism hook may rotate in space while the housing remains stationary relative to it.

It is preferable in certain embodiments for the line to be a strap having two ends. It is preferable in certain applications of this embodiment for the first end of the strap to be fixedly attached to the take-up wheel.

It is preferable in certain embodiments which use a strap to include a cable-attachment-mechanism hook. The cable-attachment-mechanism hook is attached with respect to the second end of the strap, and is configured to attach to the cable. In other versions, it is preferable to have at least two pulleys in contact with the strap, located between the first and second ends.

In other preferred embodiments of the invention, the line has a plurality of links. In certain of these embodiments, the circumferential line-engaging portion further has a plurality of radiating, spoke-like chain-engaging nubs. The spoke-like chain-engaging nubs are configured and arranged to releasably interact with the links. This de-linking could be similar to the interaction as of a bicycle sprocket and a bicycle chain.

In another embodiment of the invention, the drive transfer coupling has a ratchet-engaging drive pawl. In a specific version of the preferred embodiment, the drive-transfer coupling further has a transfer member located between the drive pawl and the actuator. The transfer member is pivotably attached with respect to the housing.

In yet another embodiment of the invention, the fluid is a gas. In still another embodiment of the invention, the fluid is a liquid. In certain specific versions, the liquid is an oil. It is preferable in certain liquid-fluid version of the invention to further comprise an electrified pump in fluidic communication with the actuator.

In another preferable embodiment, there is a spring mechanism located between the housing and the dog pawl. The spring mechanism is potentially biased to provide an engaging force to the dog pawl. The biasing allows the spring mechanism to hold the dog pawl in engagement with the ratchet in a manner resistive to counter-clockwise, anti-take-up rotation of the take-up wheel. It is more preferable in some applications of this embodiment to provide a dog pawl release for urging the dog pawl out of engagement with the ratchet. The release in these embodiments are typically user selective or user determined to allow for counter-clockwise, rotation of the take-up wheel. In this way, the chain, strap, or other line may be slackened.

In another aspect of the invention, a power-assisted cable-pulling apparatus is provided. The power-assisted cable-pulling apparatus comprises a piston, a fluid-powered means acting on the piston, a take-up wheel, a take-up-wheel axle, a fixation means, and a line with a cable-attachment mechanism. The piston has a longitudinal dimension between its first end and its second end (the second end being contained within a piston housing). The fluid-powered means acts on the piston second end. Through the fluid-powered means, the user may selectively urge the piston in positive longitudinal motion (i.e., driving the piston). The take-up wheel and the axle are concentric. The take-up-wheel axle is attached with respect to the piston housing. The axle has an axis about which the take-up wheel rotates. The take-up wheel surrounds the axle. The take-up wheel has a line-engaging portion and a concentric ratchet portion. The take-up wheel is rotatably mounted with respect to a housing. It may be placed on an axle that fits in a groove or slot in the housing. The ratchet portion is in initial touching contact with piston first end. The ratchet portion is configured and arranged such that positive longitudinal motion of the piston induces a clockwise rotation of the take-up wheel about the axle axis. The a fixation means is attached with respect to the piston housing, for holding the apparatus in place while in operation. The line has a cable-attachment mechanism, attached with respect to the take-up wheel. The cable-attachment mechanism is configured and arranged to spool about the line-engaging portion of the take-up wheel when the take-up wheel is rotated in a clockwise direction.

BRIEF DESCRIPTION OF THE DRAWINGS

FIG. 2 is a top sectional view of the embodiment of FIG. 1 taken along line 2—2 of FIG. 1.

FIG. 3 is a side, partial cut-away, sectional view of the embodiment of FIG. 2 taken along line 3—3 of FIG. 2.

DETAILED DESCRIPTION OF PREFERRED EMBODIMENTS

Figure 1:
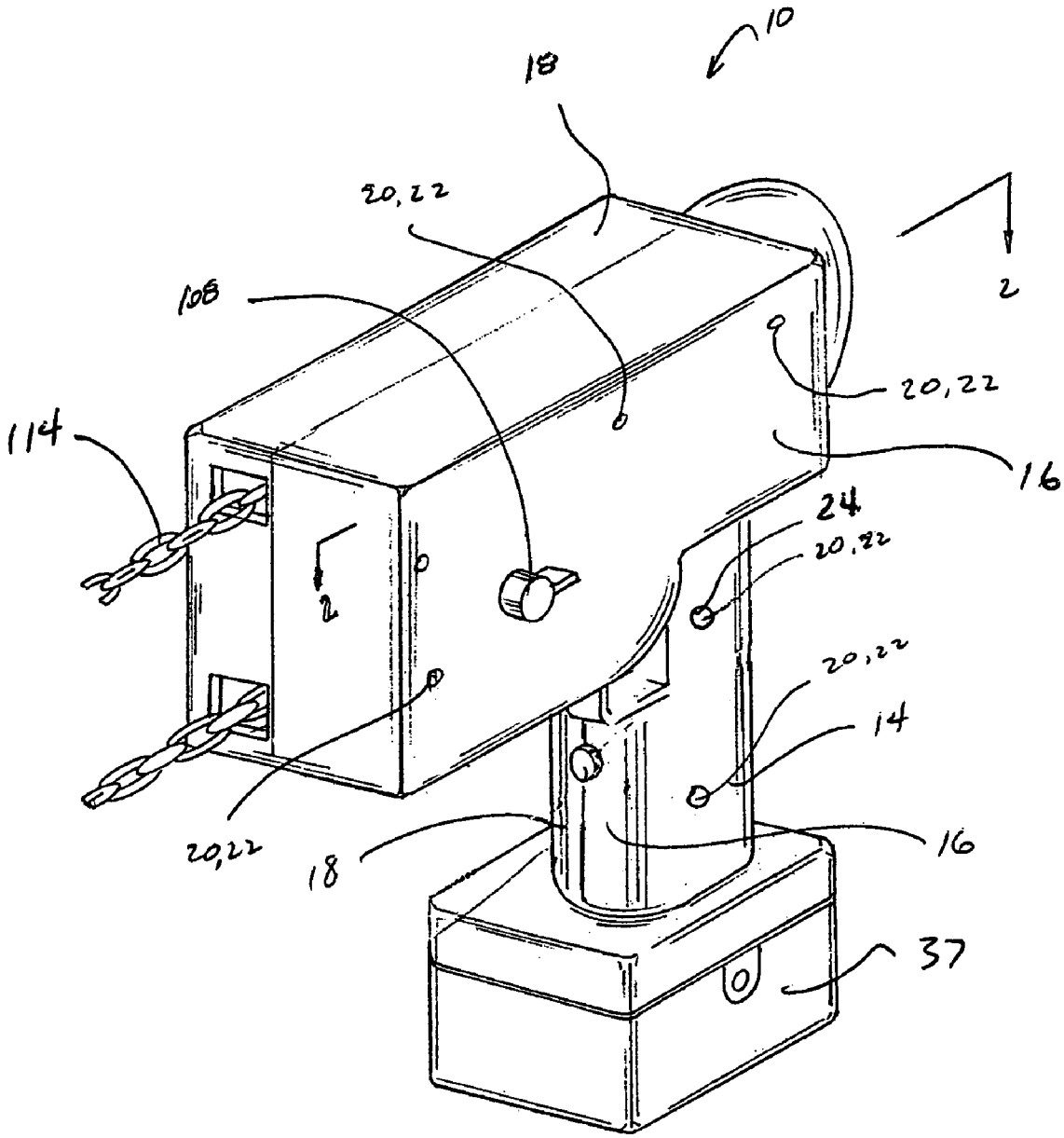
FIG. 1 is a perspective view of a preferred embodiment of the invention.
Figure 6:
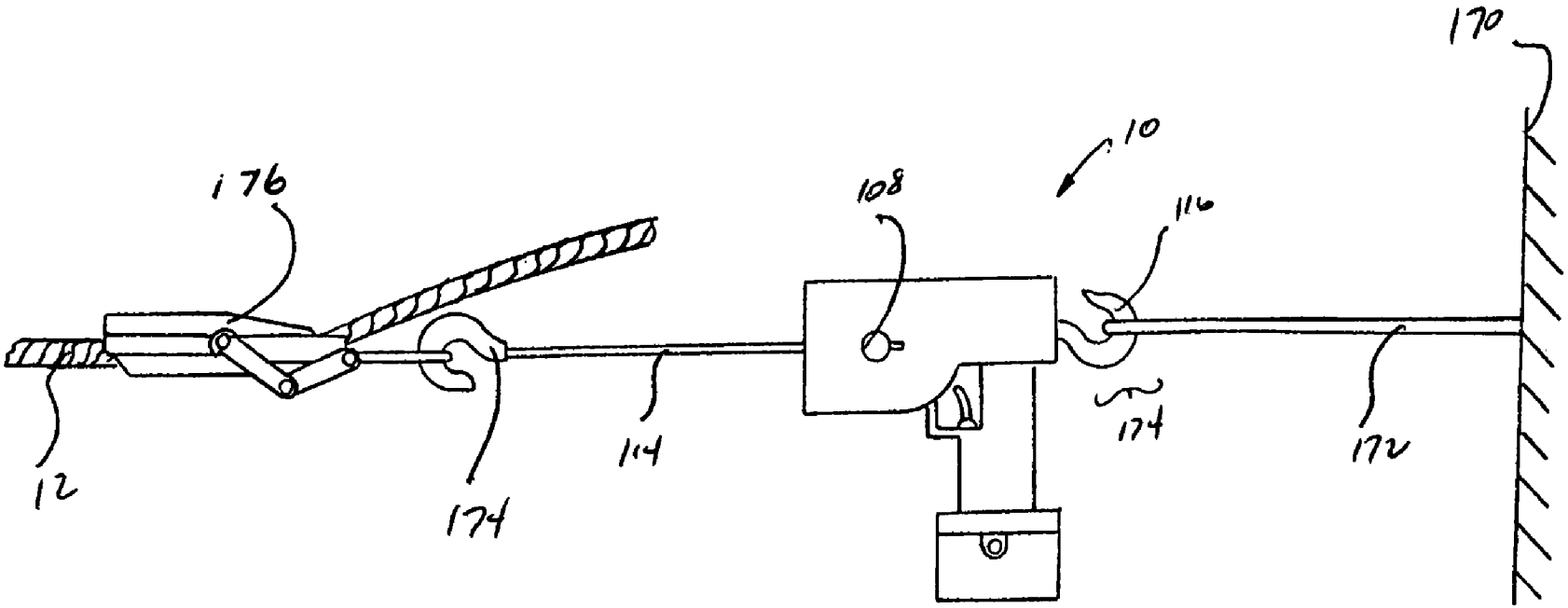
FIG. 6 is a perspective view of the invention in operation.

As seen in FIGS. 1 and 6, a cable-pulling apparatus 10 is configured to pull a cable 12. Cable-pulling apparatus 10 has a housing 14. Housing 14 is comprised of right housing portion 16 and left housing portion 18. Right and left handle housing portions 16, 18 are attached together by means of machine screws 20 with machine screw heads 22. Machine screws 20 extend through screw port 24 in right housing portion 16 where they are tightened into threaded machine screw receptors 26 (best seen in FIGS. 2 and 3). Extending out from trigger aperture 28 formed at the juncture of forward portion 30 of connected right and left housing portions 16, 18 is trigger 32. Provided also is trigger lock 33 for selectively maintaining trigger 32 in an "on" position. As seen in FIG. 3, trigger 32 is linked by linkage 34 to motor 36 (seen in FIG. 4A) which is powered by battery pack 37. Switch motor 36 is electrically linked by wires 38 to a positive displacement pump 40. Positive displacement pump 40 is of any suitable type, including vane and fan type displacement pumps. Displacement pump 40 is fluidically linked to oil reservoir bladder 42 by pump source tube 43 (which may include check valves).

Extending out from positive displacement pump 40 is tube 44. Tube 44 is in fluidic communication with three-valve solenoid 46. Also in fluidic communication with three-valve solenoid 46 is chamber tube 48.

Figure 4A:
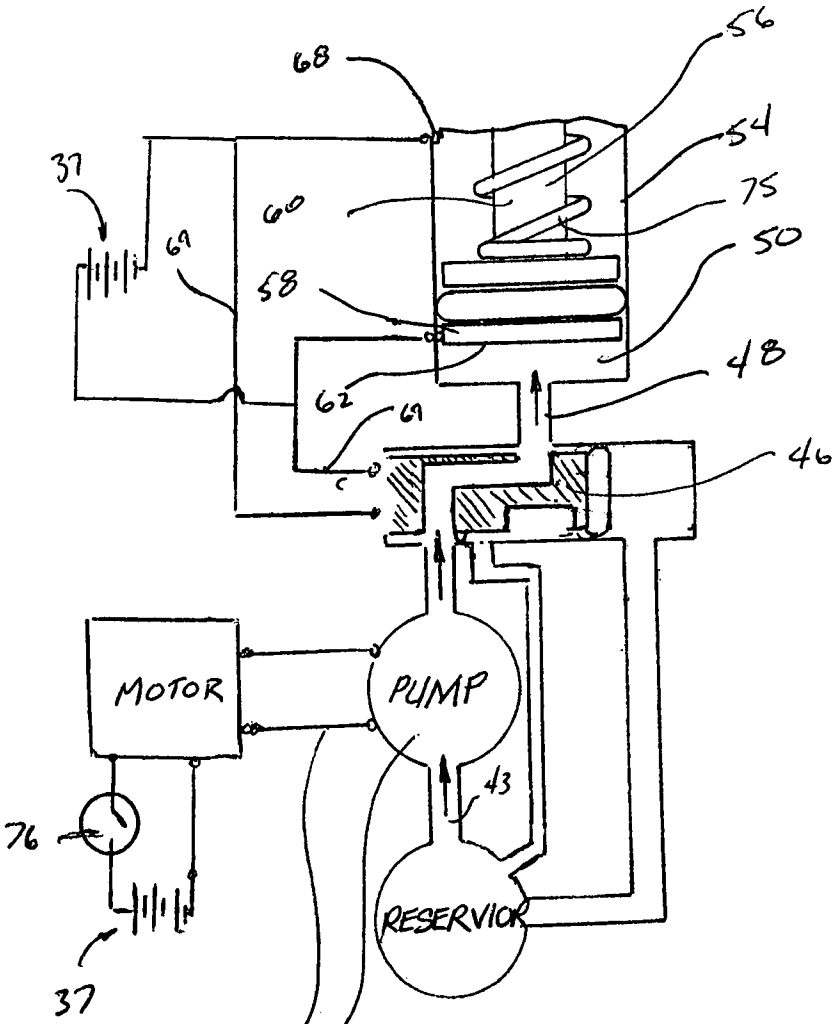
FIG. 4A is a schematic view of the power system in a first operational position.
Figure 4B:
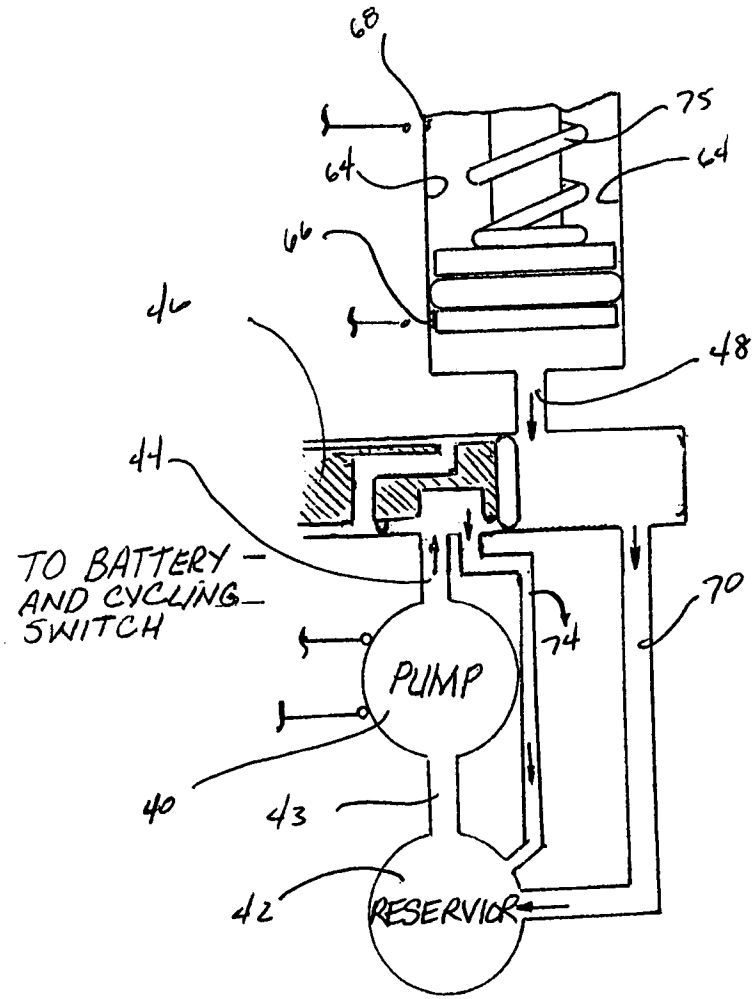
FIG. 4B is a schematic view of the power system of FIG. 4A in a second operational position.

As seen in FIGS. 4A, 4B, three-valve solenoid 46 has two positions. When in the first position illustrated in FIG. 4A, oil from oil reservoir bladder 42 may be pumped by positive displacement pump 40 through solenoid supply tube 44, through three-valve solenoid 46, and thence through chamber tube 48 into piston chamber 50 under pressure. Piston chamber 50 is at the base of piston cylinder 54. Within piston cylinder 54 is piston 56. Piston 56 is made up of a piston head 58 and piston rod 60. Piston-head face 62 forms the ceiling of the piston chamber 50.

On the interior surface 64 of piston cylinder 54 are lower and upper switches 66, 68 respectively. Lower and upper switches 66, 68 are in electrical communication with three-valve solenoid 46 through switch wires 69.

As seen in FIG. 4B, when in the second position, three-valve solenoid 46 is also in fluidic communication with piston chamber 50 through chamber drain tube 70. Extending out of three-valve solenoid 46 is recirculating tube 74. Three-valve solenoid 46 is configured such that when three-valve solenoid 46 is in the second position, fluidic communication between pump 40 chamber tube 48 is interrupted and fluidic communication between positive displacement pump 40 and oil reservoir bladder 42 through recirculating tube 74 is enabled. Moreover, when three-valve solenoid 46 is in the second position, chamber tube 48 and chamber drain tube 70 are in fluidic communication such that any oil in piston chamber 50 may return to oil reservoir bladder 42. Return of oil to reservoir bladder 42 is facilitated by the vacuum initially created in bladder 42 by pump 40 when the solenoid is in the first position, and is also facilitated piston spring 75, which is biased in a down-stroke piston direction.

As seen in FIG. 3, attached to housing is pivot 76. L-shaped translation arm 78 is pivotably attached to pivot 76. L-shaped translation arm 78 has a piston end 80 and a ram end 82. Piston end 80 is configured to receive strikes from a top end 84 of piston rod 60. It will be noted here that the words "top", "bottom", "up", "down", "base", "horizontal", "vertical" are all used with reference to the diagrams for ease of understanding. It will be readily seen that the unit may be operated in any direction and in any orientation such that what is described as "up" for purposes of this description may actually be downward toward the earth in operation of the unit in certain applications. Moreover, what will be described in terms of "clockwise" and "counter-clockwise", are intended to refer to opposite directions of rotations; obviously what is considered "clockwise" is dependent on perspective and use of such terms herein is not limiting to particular perspectives illustrated.

As top end 84 is driven upwardly to engage piston end 80, rotation is introduced to translation arm 78 such that the upwardly driven motion is translated in a horizontal matter as ram end 82 interacts with piston end 86 of ram piston 88. Ratchet end 89 of ram piston 88 interacts with drive sprocket teeth 90 on ratchet wheel 91 which is integral and concentric with take-up wheel 92. Take-up wheel 92 rotates about wheel pivot 94. Wheel pivot 94 is attached to right housing portion 16. Together with left housing portion 18, right housing portion 16 generally encloses take-up wheel 92. Such enclosure is beneficial for multiple reasons, including four the safety of the operator, and the protection of the unit from external instrumentalities and dirt.

Take-up wheel 92 is driven in a clockwise direction by the action of ram piston 88. In forward operation, counter-clockwise rotation of take-up wheel 92 is prohibited by dog pawls 102. In a fashion well known in the industry, dog pawls 102 rotate into engagement about pawl access 104. Dog pawls 102 are biased into engagement with ratchet teeth 90 by pawl springs 106. As also well known in the ratchet tool industry, ratchet may be selectively released in a counter-clockwise direction (e.g., see U.S. Pat. No. 6,805,028 issued to Chang). Reversibility is selected by reversing switch 108.

Take-up 92 has a circular, disk-like chain-take-up portion 110 concentric with the ratchet portion wheel 91. Around perimeter of chain-take-up portion 110 are radically-extending chain teeth 112. Chain teeth 112 encounter chain 114.

Integral with right housing portion 16 is tail-hook 116.

Figure 5A:
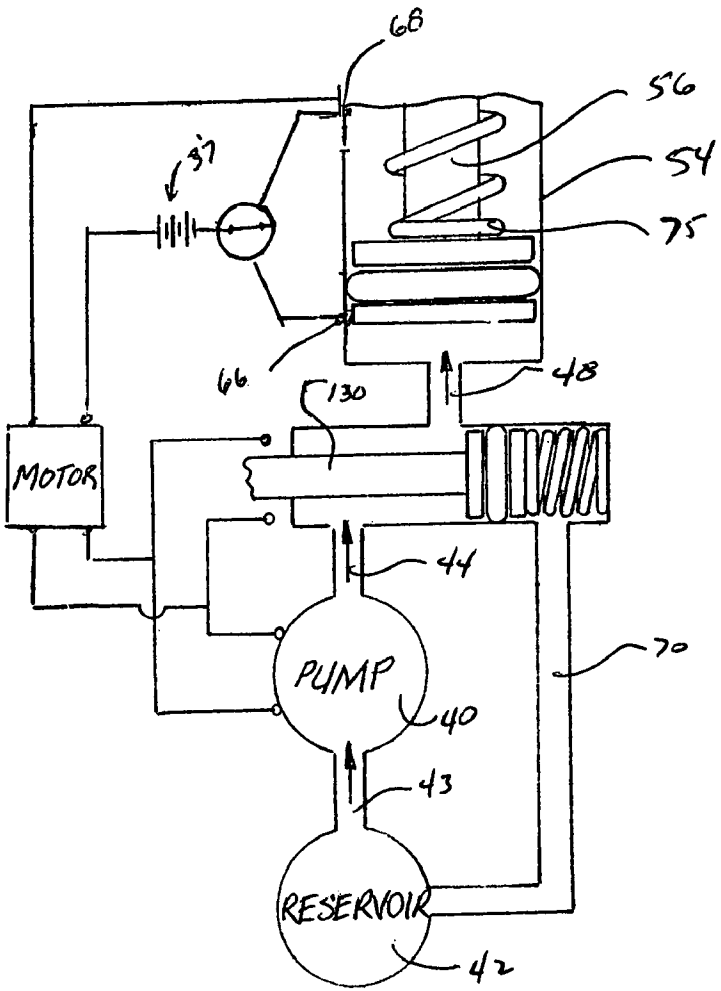
FIG. 5A is a schematic view of an alternate embodiment of the power system in a first operational position.
Figure 5B:
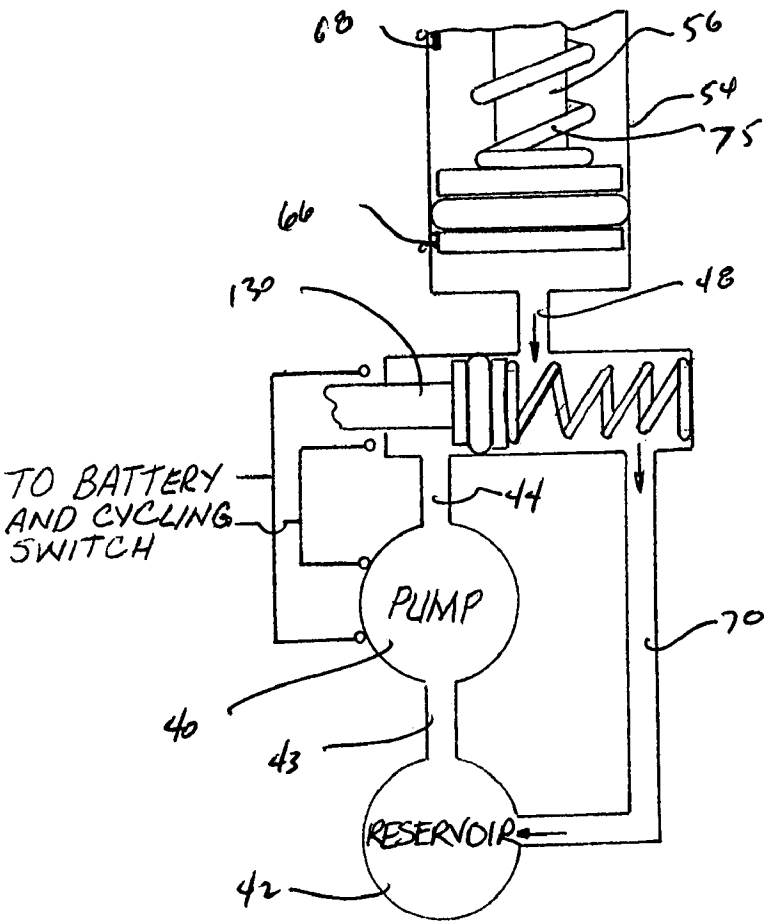
FIG. 5B is a schematic view of the power system mechanism of FIG. 5A in a second operational position.

Use of the three-valve solenoid 46 allows for positive displacement pump 40 to remain in continuous operation while trigger 32 is depressed. An alternative hydraulic system is schematically illustrated in FIGS. 5A and 5B. As with the three-valve solenoid 46, two-valve solenoid 130 has two positions. When in the first position illustrated in FIG. 5A, oil from oil reservoir bladder 42 may be pumped by positive displacement pump 40 through solenoid supply tube 44, through two-valve solenoid 130, and thence through chamber tube 48 into piston chamber 50 under pressure.

As seen in FIG. 5B, when in the second position, two-valve solenoid 130 is also in fluidic communication with piston chamber 50 through chamber drain tube 70. Two-valve solenoid 130 is configured such that when two-valve solenoid 130 is in the second position, chamber tube 48 and chamber drain tube 70 are in fluidic communication such that any oil in piston chamber 50 may return to oil reservoir bladder 42. As with the prior embodiment, return is facilitated both by the vacuum in bladder 42 created by pump 40 when in the first position and by piston spring 75.

It will be readily observed in the relevant hydraulics area that check valves (e.g., in pump source tube 43) and relief valves (e.g., in supply tube 44) will be engineered for safe and efficient operation of the hydraulic system.

In the hydraulic systems when activated by trigger 32, oil is pulled from bladder 42 into piston chamber 50 driving piston 56. Piston 56 indirectly drives ram 88. Ram 88 drives ratchet 90 rotating take-up wheel 92. Rotating take-up wheel 92 draws chain 114 by means of teeth 112.

As piston 56 reaches apex point remote from the cylinder base, piston head 58 trips upper switch 68. Upper switch 68 causes emptying of chamber 50 by movement of solenoid from first position (illustrated respectively in FIGS. 4A, 5A) to the second position (illustrated in FIGS. 4B, 5B respectively). As piston head 58 reaches nadir within chamber 50, piston head 58 trips lower switch 66 causing pump to refill chamber 50 by switching solenoid from second position (illustrated in FIGS. 4B, 5B) to the first position (illustrated in FIGS. 4A, 5A, respectively). Refilling piston chamber 50 with oil redrives piston 58, thereby indirectly rotating take-up wheel 92, further drawing chain 114.

Figure 7:
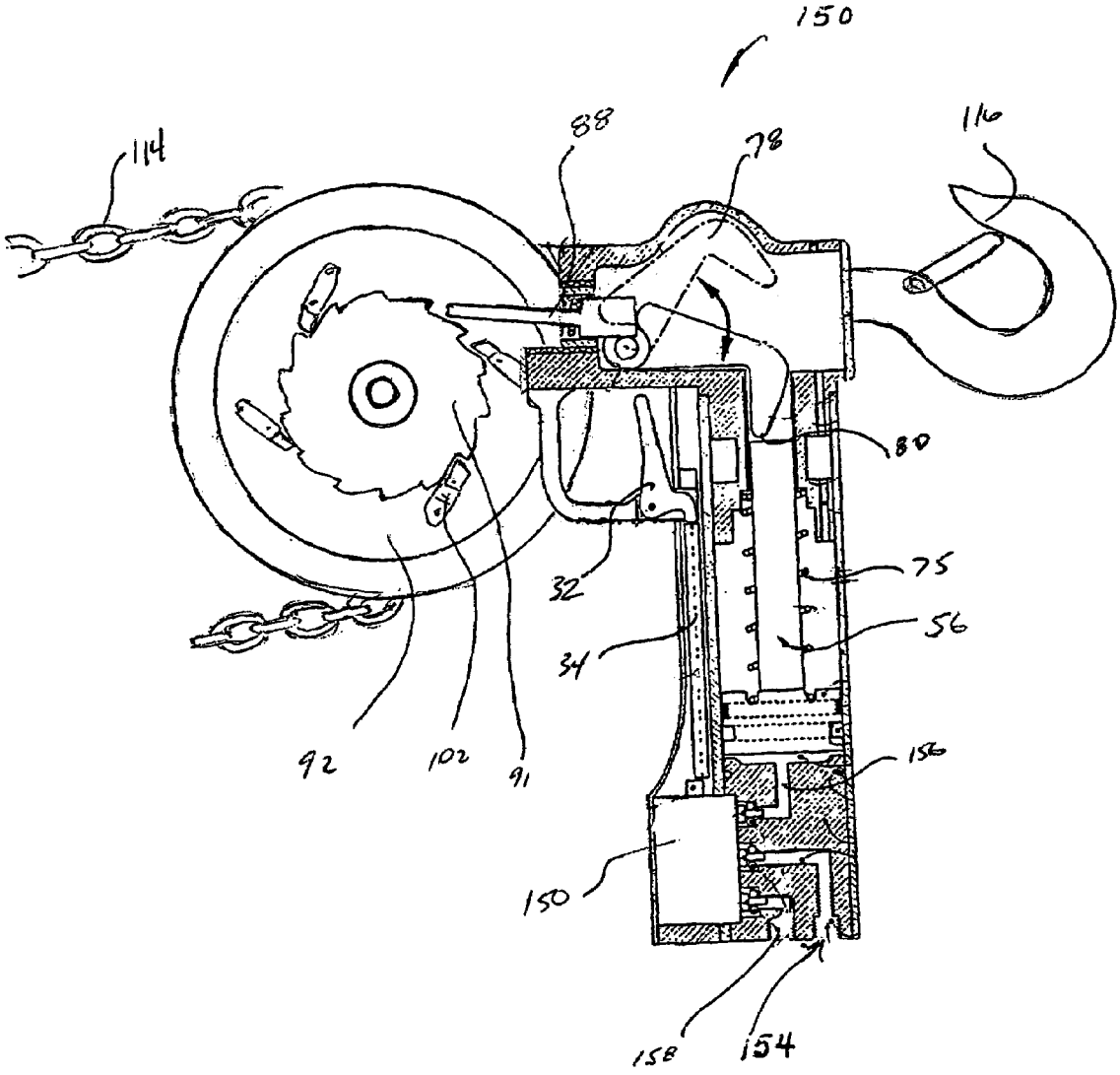
FIG. 7 is a sectional cut-away side view of an alternate embodiment of the invention.

As illustrated in FIG. 7, the system may also operate pneumatically. As illustrated in FIG. 7, trigger 32 is linked by linkage rod 34 to actuator 150. Actuator 150 causes compressed gas (from an external gas source (such as a compressor or cartridge) not shown) through gas inlet channel 154 and chamber supply channel 156 into piston chamber 50 forcing piston 56 to drive ram 88 through translation arm 78 to in turn drive ratchet wheel 91. In a similar manner to the pneumatic system, piston spring 75 allows for return of piston to its nadir position (thereby decreasing volume of piston chamber 50) when air is evacuated through chamber supply channel 156 and gas exit port 158 upon release of the trigger. Through multiple activations of trigger 32, take-up chain 114 is incrementally pulled by take-up wheel 92 in a manner similar to that described above with regard to the hydraulic systems.

Figure 8:
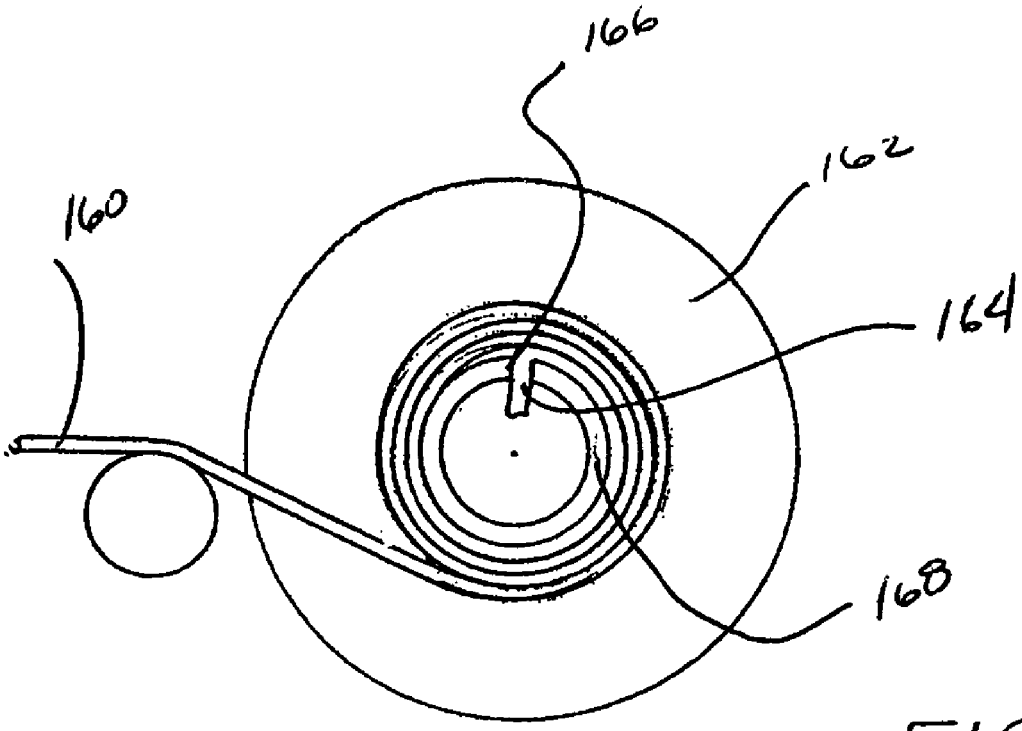
FIG. 8 is a sectional cut-away side view of an alternate embodiment of the take-up wheel.

FIG. 8 illustrates the use of a strap 160 as an alternative to a take-up chain 114. Strap 160 is attached to take-up wheel 162 by means of insertion of strap first end portion 164 into fixing aperture 166. Strap 160 is then reeled onto hub 168. Take-up wheel 92 is driven by the ratchet 90 described above. Hub 168 and ratchet wheel 91 are concentric, each rotating about wheel pivot 94. Two-pulley block-and-tackle 169 may be added for increased mechanical power.

As seen in FIG. 6, in operation, unit 10 is affixed to a structure 170 (such as a tree, telephone pole, building, or truck). Attachment cable 172 is configured to firmly attach to fixture 170 in a manner not to come loose or break during the cable-drawing process. Fixation means 172 has a hook-receiving second end 174. Hook 116 is attached to fixation means 172 at second end 174.

Attached to chain 114 is cable hook 174, which in turn is hooked to cable fixation mechanism 176. Cable fixation mechanism 176 is well known in the industry and firmly grips cable 12. Once unit 10 is firmly affixed in its relative position between cable 12 and structure 170, trigger 32 of unit is deployed by a user. Through continual ratcheting within unit 10, chain 114 is drawn into unit 10 forcing cable 12 into motion toward fixture 172.

Once cable 12 has been moved position, the unit 10 is released. If under tension, cable 12 is first secured with respect to structure 172; if cable 12 is otherwise untensioned, cable 12 does not need to be secured. When cable 12 is secured in desired position, release mechanism 108 is deployed. Such release mechanisms to allow for back ratcheting are well described in the prior art.

While the principles of the invention have been shown and described in connection with specific embodiments, it is to be understood that such embodiments are by way of example and are not limiting.

The invention claimed is:

1. A hand held, power-assisted cable-pulling apparatus comprising:

a housing having:

a hollow handle body with a fluid-powered actuator;

a fluid control valve, for controlling fluid pressure supply to the actuator;

and an operating trigger for the control valve;

a disc-like take-up wheel, having a circumferential line-engaging portion and having a concentric ratchet portion;

a take-up wheel shaft extending through a center of the take-up wheel, and attached with respect to the housing, configured and arranged such that the take-up wheel can rotate about a longitudinal axis of the shaft;

a drive transfer coupling, for operative driving connection between the actuator and the ratchet portion, at least one ratchet-portion-engageable dog pawl pivotally attached with respect to the housing;

a line having a cable attachment mechanism and non-slippingly engaged with the take-up-wheel line-engaging portion; and a ground fixation mechanism attached with respect to the housing for maintaining the housing fixed in space, whereby the take-up wheel may be selectively rotated in a clockwise take-up direction.

2. The cable-pulling apparatus of claim 1 wherein the ground fixation mechanism includes a fixation-mechanism hook.

3. The cable-pulling apparatus of claim 2 wherein the fixation-mechanism hook has a fixation-mechanism-hook axis and is rotatable about the fixation-mechanism-hook axis with respect to the housing.

4. The cable-pulling apparatus of claim 1 wherein the line is a strap having a first end and a second end.

5. The cable-pulling apparatus of claim 4 wherein the strap first end is fixedly attached to the take-up wheel.

6. The cable-pulling apparatus of claim 5 wherein the cable-attachment mechanism includes a cable-attachment-mechanism hook attached with respect to the second end of the strap, and located between the second end and the cable.

7. The cable-pulling apparatus of claim 5 further comprising at least two pulleys in contact with the strap, and located between the first and second ends.

8. The cable-pulling apparatus of claim 1 wherein the line has a plurality of links.

9. The cable-pulling apparatus of claim 8 wherein the circumferential line-engaging portion further has a plurality of radiating, spoke-like chain-engaging nubs, configured and arranged to releasably interact with the links.

10. The cable-pulling apparatus of claim 1 wherein the drive transfer coupling has a ratchet-engaging drive pawl.

11. The cable-pulling apparatus of claim 10 wherein the drive-transfer coupling further has a transfer member located between the drive pawl and the actuator, and said transfer member is pivotably attached with respect to the housing.

12. The cable-pulling apparatus of claim 1 wherein the fluid is a gas.

13. The cable-pulling apparatus of claim 1 wherein the fluid is a liquid.

14. The cable-pulling apparatus of claim 13 wherein the liquid is an oil.

15. The cable-pulling apparatus of claim 13 further comprising an electrified pump in fluidic communication with the actuator.

16. The cable-pulling apparatus of claim 1 further comprising a spring mechanism located between the housing and the dog pawl, potentially biased to provide an engaging force to the dog pawl thereby holding the dog pawl in engagement with the ratchet in a manner resistive to counter-clockwise, anti-take-up rotation of the take-up wheel.

17. The cable-pulling apparatus of claim 16 further comprising a dog pawl release for selectively urging the dog pawl out of engagement with the ratchet, thereby allowing for counter-clockwise, anti-take-up rotation of the take-up wheel.

18. A power-assisted cable-pulling apparatus comprising:

a piston having a first end, a second end, and a longitudinal dimension therebetween, with the second end contained within a piston housing;

a fluid-powered means acting on the piston second end, for selectively urging the piston in positive longitudinal motion;

a take-up-wheel axle having an axle axis, attached with respect to the piston housing;

a take-up wheel, concentric with the axle and surrounding a radial portion of the axle, having a line-engaging portion and a concentric ratchet portion, rotatably mounted with respect to a housing, said ratchet portion in initial touching contact with piston first end, configured and arranged such that positive longitudinal motion of the piston induces a clockwise rotation of the take-up wheel about the axle axis;

a fixation means attached with respect to the piston housing, for holding the apparatus in place while in operation;

a line having a cable-attachment mechanism, attached with respect to the take-up wheel, configured and arranged to spool about the line-engaging portion of the take-up wheel when the take-up wheel is rotated in a clockwise direction.

* * * * *